US006046415A

United States Patent [19]

Briski

[11] Patent Number: 6,046,415

[45] Date of Patent: Apr. 4, 2000

[54] ELECTRIC SWITCH

[75] Inventor: Tony M. Briski, Ridgefield, Wash.

[73] Assignee: Land-Mekra North America, LLC, Ridgeway, S.C.

[21] Appl. No.: 09/191,473

[22] Filed: Nov. 12, 1998

[51] Int. Cl.[7] ..... H01H 1/30

[52] U.S. Cl. ..... 200/247; 200/9

[58] Field of Search ..... 200/245–247, 200/512, 517, 8 R, 9, 8 A, 11 K, 239, 570, 571, 6 A

[56] References Cited

U.S. PATENT DOCUMENTS 3,383,478 5/1968 Mandel ..... 200/8

4,348,556 9/1982 Gettig et al. ..... 200/5 R

*Primary Examiner*—M. L. Gellner

*Assistant Examiner*—Nhung Nguyen

*Attorney, Agent, or Firm*—Olson & Olson

[57] ABSTRACT

A multiple electric switch is formed by inserting a plurality of electrical contacts in a plurality of spaced apart holes in a base of electrically non-conductive elastomeric material, in groups of two pairs per group, and mounting a control member in the base for movement to move one of the pair of contacts of a group resiliently into engagement with the other pair of contacts of the group, to effect closing of the electric switch. A second group of electrical contacts are spaced apart in a circular pattern adjacent a circular, electrically conductive contact ring, and a cam member on the base is rotatable to engage and move each of the contacts, one at a time, resiliently into engagement with the contact ring. The second group of contacts are included in the electric circuit of the first groups of contact pairs to effect control of multiple movements of each of a plurality of electric loads.

9 Claims, 4 Drawing Sheets

ELECTRIC SWITCH

BACKGROUND OF THE INVENTION

This invention relates to electric switches, and more particularly to an electric switch in which an elastomeric base mounts electrical contacts for movement between open and closed positions.

Although many electric switches employ elastomeric components, such as disclosed in U.S. Pat. Nos. 3,699,294; 3,784,941; and 3,973,099 none is known to employ an electrically non-conductive elastomeric base for resiliently supporting movable electrical contacts.

SUMMARY OF THE INVENTION

The electric switch of this invention includes an elastomeric base in which electrical contacts are mounted for movement between open and closed positions by an actuator also mounted in the elastomeric base for movement therein to move the elastomer and an electrical contact into engagement with an associated electrical contact.

It is the principal objective of this invention to provide an electric switch of the class described in which an elastomeric base provides the sole support for electrical contacts.

Another objective of this invention is to provide an electric switch of the class described in which an elastomeric base affords removable mounting of electrical contacts for ready replacement and repair.

Still another objective of this invention is to provide an electric switch of the class described in which an elastomeric base affords the mounting of a plurality of groups of electrical contacts in patterns operable by a common actuator.

A further objective of this invention is the provision of an electric switch of the class described designed specifically to provide vertical and horizontal adjustments of a motor-operated device.

A still further objective of this invention is to provide an electric switch of the class described designed specifically to provide control of eight truck-mounted mirrors adjustable by electric motors.

A further objective of this invention is the provision of an electric switch of the class described which is of simplified construction for economical manufacture, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 5:
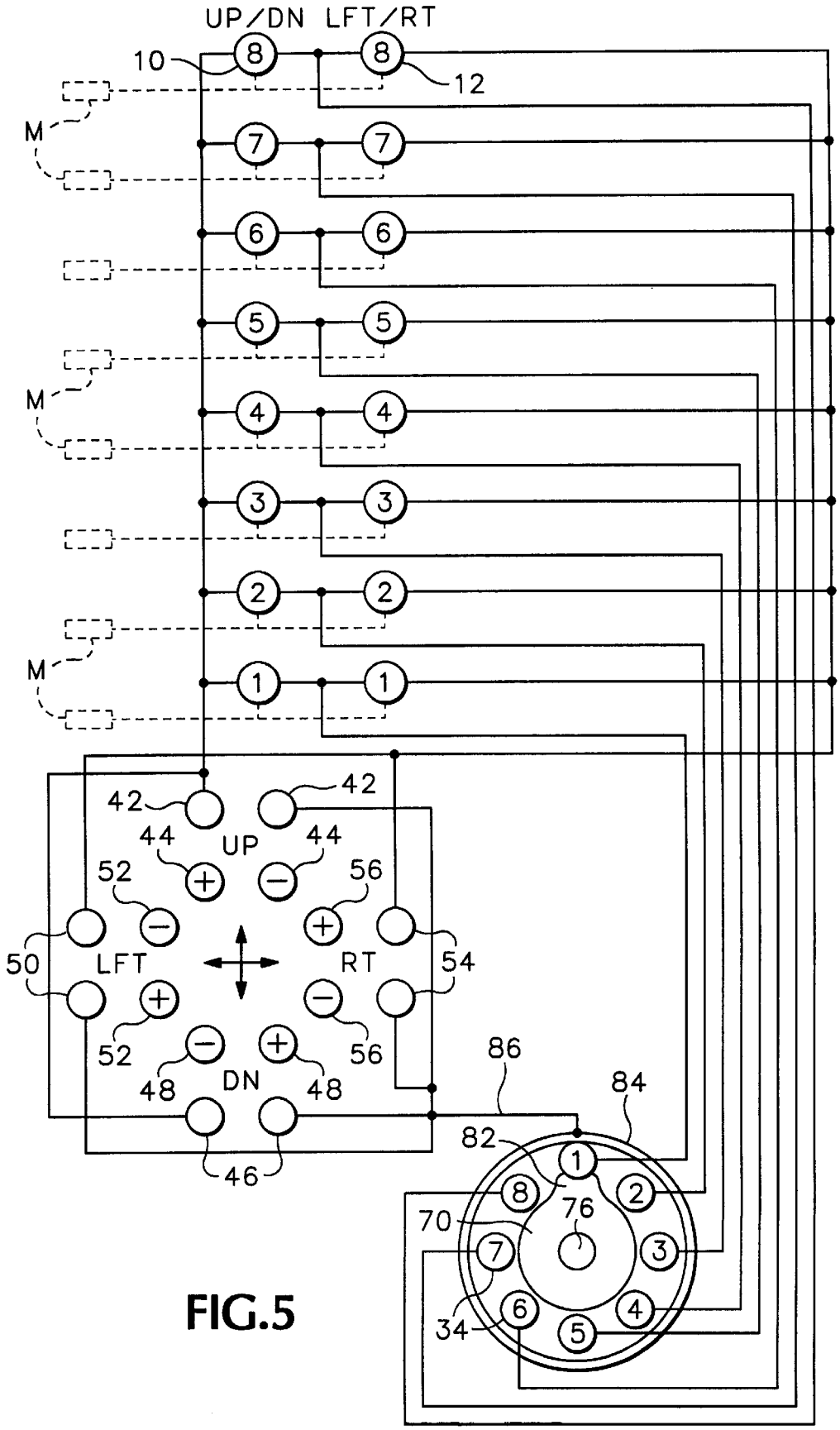
FIG. 5 is a schematic diagram of an electric circuit for use with the electric switch of the preceding figures.

For purposes of describing the embodiment of the electric switch shown in the drawings, the electric circuit of FIG. 5 illustrates the control of eight truck-mounted mirrors M each operated by two electric motors 10 and 12. Motor 10 controls the vertical, up and down adjustment of the mirror, and motor 12 controls the horizontal, left and right adjustment of the mirrors. The motors are numbered to correspond with the eight mirrors which are located at appropriate positions on a truck.

Figure 2:
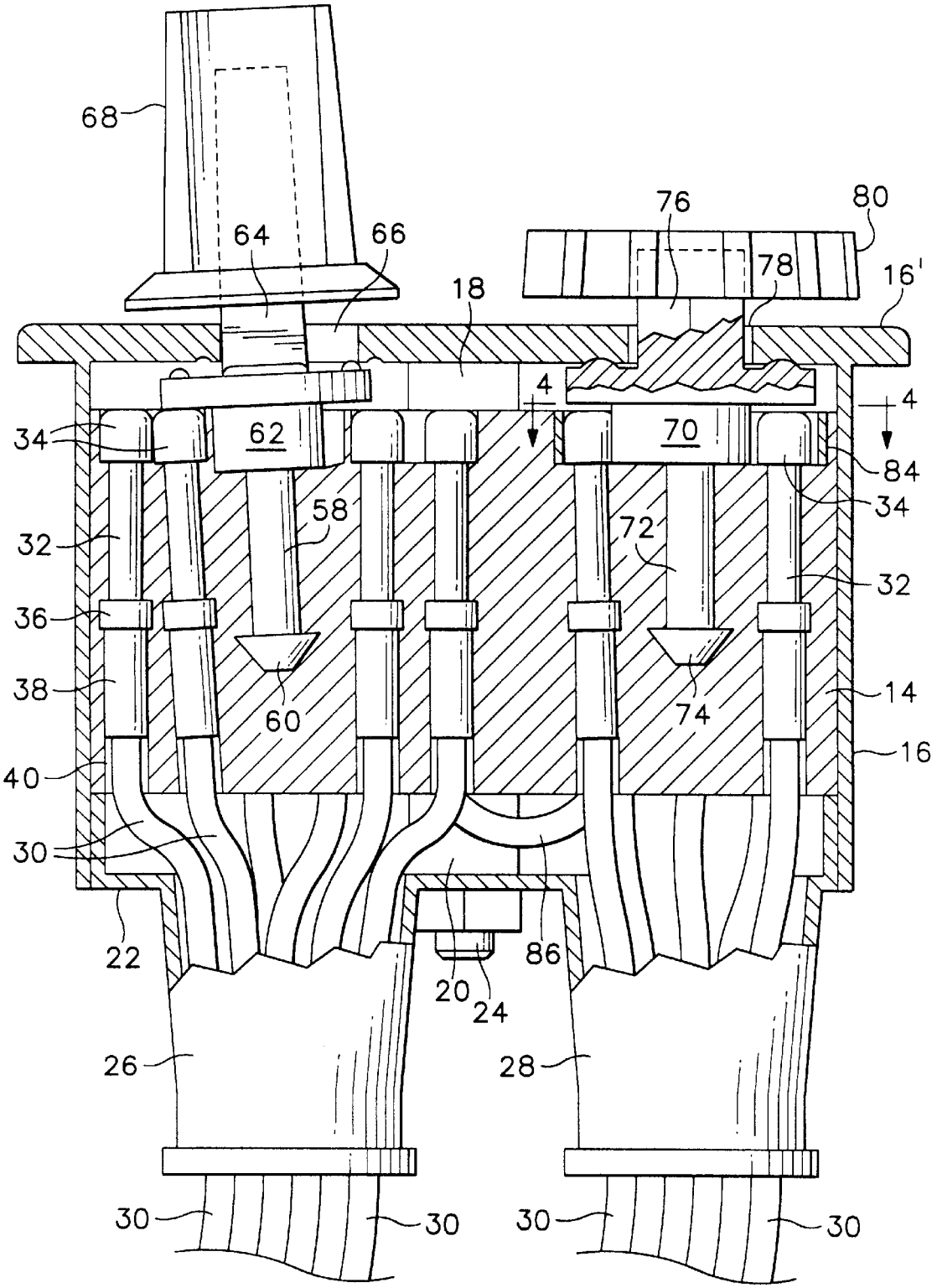
FIG. 2 is a vertical section, on an enlarged scale, taken on the line 2—2 in FIG. 1.

Referring to FIG. 2 of the drawings, the electric switch illustrated includes a one-piece base 14 of electrically non-conductive elastomeric material. The base is contained in a substantially rigid case 16 of electrically non-conductive material, such as synthetic resin. Spacer blocks 18 retain the base a spaced distance under the top plate 16' of the case and spacer blocks 20 are interposed between the bottom side of the base and the bottom cover 22 of the case. The spacer blocks 18 and 20 secure the base 14 between them. The bottom cover is secured removably to the case 16 by bolts 24.

The bottom cover 22 is configured with a pair of downwardly extending hollow ferrules 26 and 28 for confining a plurality of electrical conductors 30 for interconnecting switch contacts, battery source of electric potential and the mirror drive motors, as described hereinafter.

In the embodiment illustrated, a plurality of electrical contacts 32 are mounted in the base 14. Each contact is made of electrically conductive metal, such as copper, silver, etc., and is configured with an enlarged head 34 and an intermediate enlarged shoulder 36. The bottom end portion 38 below the shoulder is hollow for containing a bare terminal end portion of an electrical conductor 30 which is secured in the bore by such means as solder.

Each contact 32 is installed in the base 14 by inserting it into an opening 40 formed in the base. The opening is smaller in diameter than the contact shoulder 36 and end portion 38, but the elastic character of the base allows the contact to be inserted into the opening where it is retained removably by the enlarged head 34 and shoulder 36. Accordingly, the contact may be replaced, if necessary, with speed and facility.

Figure 3:
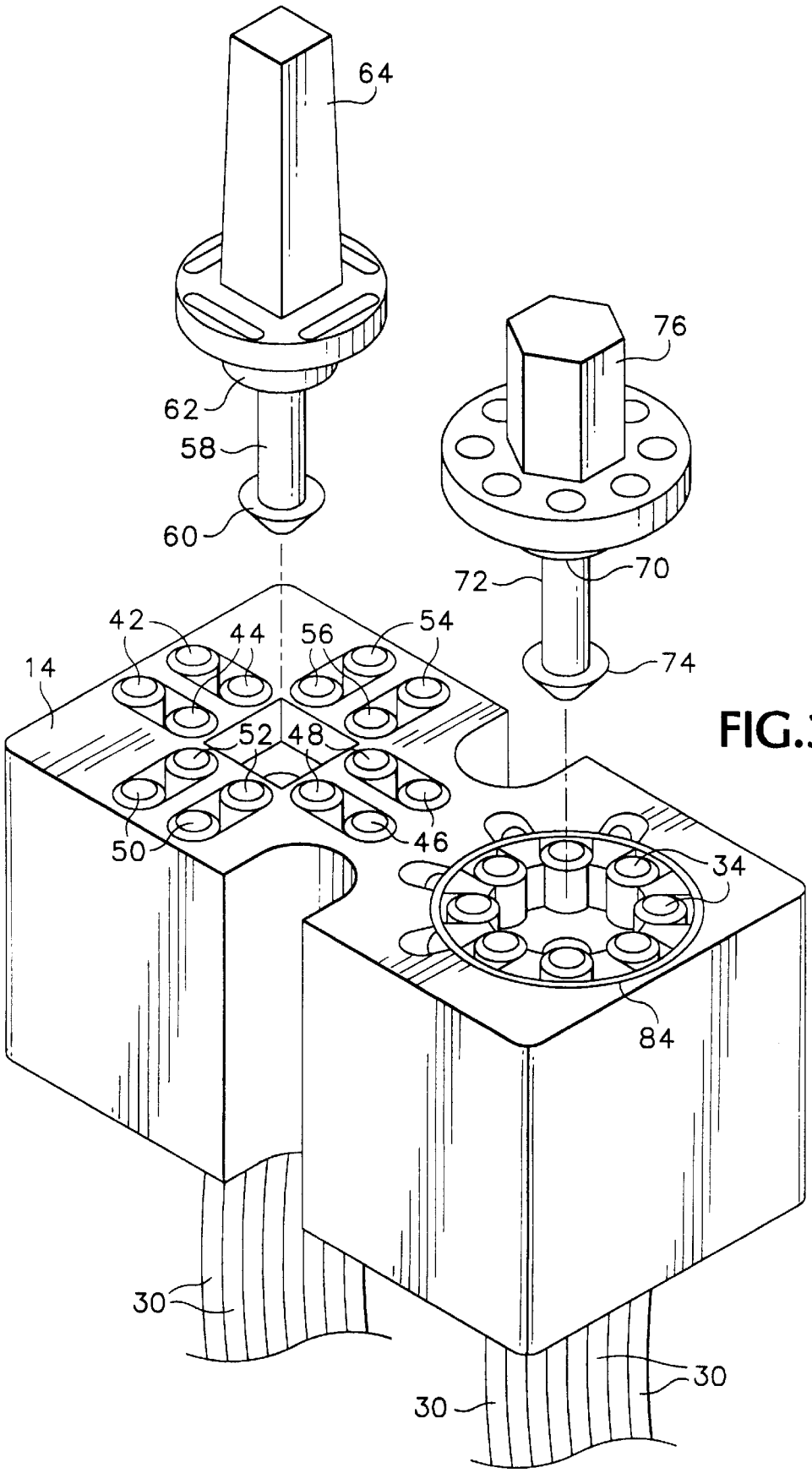
FIG. 3 is an exploded perspective view of the electric switch of FIG. 2 with the outer case removed.

The plurality of contacts are installed in the base 14 in the pattern of openings 40 to provide adjustment of each of the eight mirrors in both vertical and horizontal directions. Referring primarily to FIGS. 3 and 5 of the drawings, four contacts are disposed in adjacent pairs 42 and 44 for controlling each of the vertical adjustment motors in the "up" direction; four other contacts are disposed in adjacent pairs 46 and 48 for controlling each of the vertical adjustment motors in the "down" direction; four other contact pairs 50 and 52 are disposed for controlling each of the horizontal adjustment motors in the "left" direction; and four other contact pairs 54 and 56 are disposed for controlling each of the horizontal adjustment motors in the "right" direction.

Each group of four contacts includes two contacts which are connected to the positive and negative terminals of a battery source of electric potential, as indicated in FIG. 5. The associated pair of contacts are connected across the associated mirror drive motor.

Referring to FIG. 2 of the drawings, actuator means is provided for moving one pair of contacts resiliently toward and into engagement with the associated pair of contacts to energize the corresponding drive motor and move the associated mirror in the direction desired. In the embodiment illustrated, the actuator means is a joystick. It is formed with an inner shaft section 58 terminating in an enlarged head 60, for retaining the joystick removably in the elastomeric base 14. An intermediate enlarged actuator section 62 is positioned in registry with the heads 34 of the contacts, and an outer section 64 projects upward through an opening 66 in the top plate 16' of the case. A cap 68 is secured removably to outer section 64 for gripping by the fingers of an operator. The opening 66 is sufficiently large to allow movement of the section 64 of the joystick in the four directions of the four groups of contacts.

Another group of contacts serves to select any one of the eight mirrors for adjustment. Thus, eight contacts 32 are spaced apart in a circular pattern in openings 40 in the base 14. An operating cam 70 is positioned within the circular pattern of contacts and is secured removably in the base by a shaft extension 72 inserted in an opening in the base. An enlarged end 74 on the shaft section serves to resist removal of the shaft section from the base.

Figure 1:
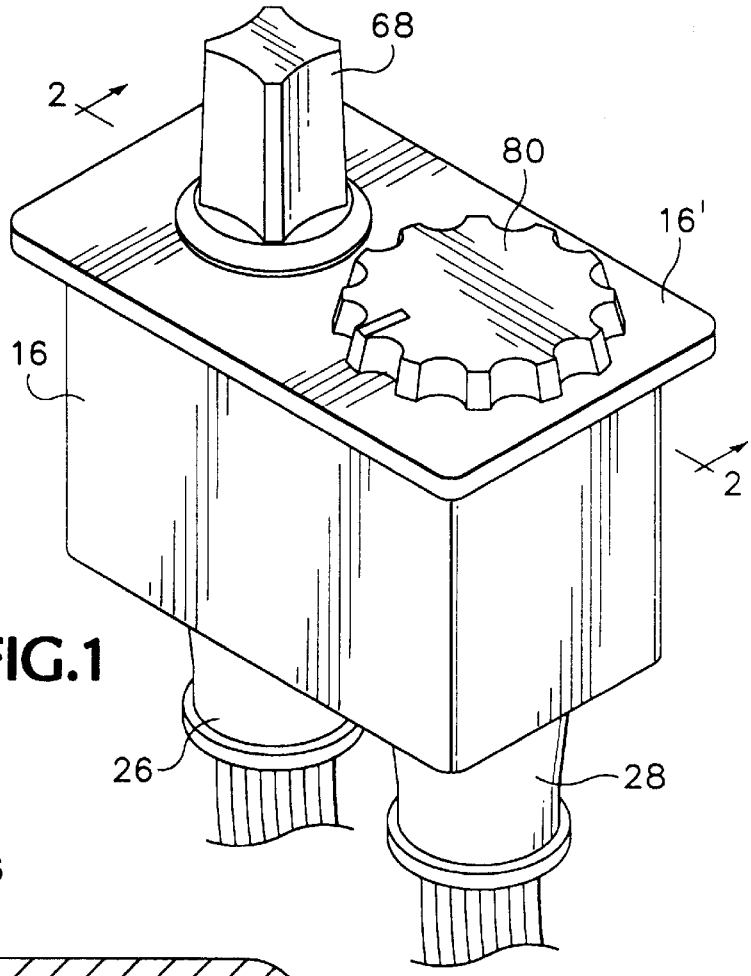
FIG. 1 is a fragmentary perspective view of an electric switch embodying the features of this invention.
Figure 4:
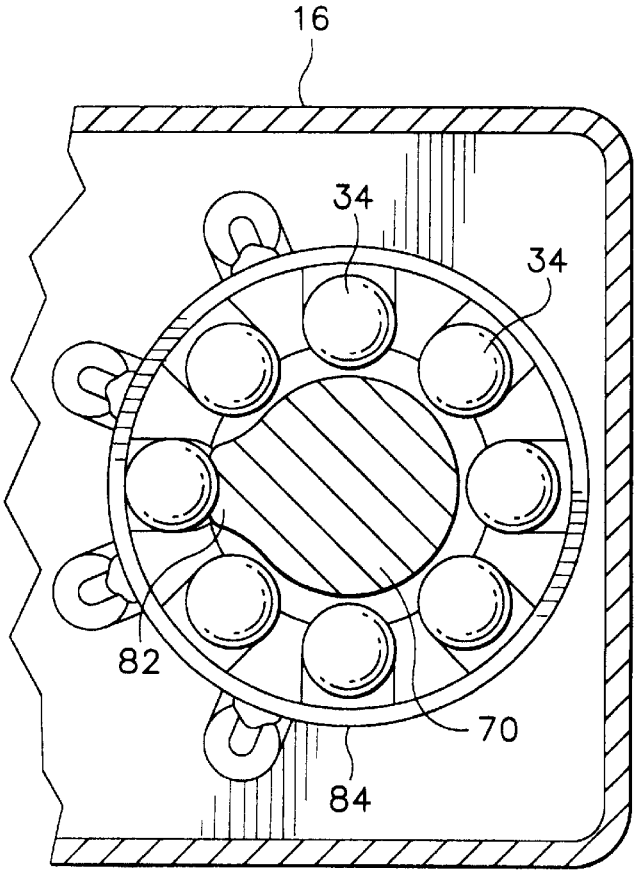
FIG. 4 is a fragmentary sectional view, on an enlarged scale, taken on the line 4—4 in FIG. 2.

Extending upwardly from the cam 70 is an outer section 76 of reduced diameter. It projects upwardly through an opening 78 in the top plate 16 and mounts a knob 80 for gripping by the fingers of an operator, to effect rotation of the cam 70. A radially extending lobe 82 (FIGS. 4 and 5) of the cam 70 is disposed to engage each of the heads 34 of the circular pattern of contacts 32, one at a time during rotation of the cam, and to move the head radially outward into engagement with a circular contact ring 84 of electrically conductive metal. The ring is connected to an electrical conductor 86 for completing the electric circuit of a selected one of the eight mirror drive motor systems.

It will be apparent that the ring 84 serves as an associated contact for each of the contacts 32 in the circular pattern and is a convenient substitute for a plurality of contacts all connected together electrically to the conductor 86. Thus, the ring forms the second contact associated with each of the contacts 32 in the circular pattern to form a plurality of contact pairs.

FIG. 5 shows the lobe 82 engaging the contact head for mirror number 1, whereby the contact head is moved radially outward into engagement with contact ring 84 to complete the electric circuit of the motor assembly of mirror number 1.

The operation of the electric switch described hereinbefore is as follows: In the illustrated arrangement of FIG. 5, the selector lobe 82 has moved the contact head 34 for mirror number 1 into electrical engagement with contact ring 84. Let it be assumed that it is desired to move mirror number 1 upward. Accordingly, the joystick is tilted in the direction to move the pair of contacts 44 into electrical engagement with the associated pair of contacts 42. Accordingly, the electric circuit is completed from the positive battery terminal of the contact pair 44 and the engaged terminal of contact pair 42, through drive motor 10 for mirror number 1, to the selected contact number 1 and engaged contact ring 84, to the negative battery terminal through engaged negative contacts of pairs 42 and 44.

Let it now be assumed that it is desired to move mirror number 1 leftward. Accordingly, the joystick is tilted toward the left to move battery contact pair 52 into electrical engagement with associated contact pair 50. The electric circuit of the left/right motor 12 for mirror number 1 thus is completed from the positive battery terminal contact 52 and engaged contact 50 through conductor 86, contact ring 84 and selector contact number 1, through the motor 12 of mirror number 1 and the engaged negative contacts of pairs 50 and 52 to the negative terminal of the battery supply.

It is to be noted that movement of the up/down motor 10 in the downward direction is achieved by tilting the joystick downward to close the contact pair 48 with contact pair 46. Since the polarity of the battery contacts 48 is reversed from the battery contacts 44, the motor 10 for mirror number 1 is driven in the reverse direction to move the mirror downward. Similar reverse polarity is provided between the battery contact pairs 52 and 56 for left/right movements.

It also is to be noted that the above described movements in the vertical and horizontal directions are available for each of the eight mirrors illustrated, simply by rotating the selector cam 70 and the lobe 82 to move each contact head 34, one at a time, against the contact ring 84.

The electric switch of this invention may accommodate any number of controls and in any spatial configuration desired, by providing openings 40 in the base 14 in the desired pattern. The resilient, non-conductive base serves to support the contacts removably and resiliently for movement between open and closed positions. The simplicity of a minimum number of components affords manufacture and assembly with facility and economy in a wide variety of configurations.

It will be apparent to those skilled in the art that various changes may be made in the size, shape, type, number and arrangement of parts described hereinbefore. For example, the joystick may be mounted exteriorly of the elastomeric base but arranged to bear against the elastomer and press it against an adjacent electrical contact, to move the contact into electrical engagement with an associated electrical contact. This and other changes may be made without departing from the spirit of this invention and the scope of the appended claims.

I claim:

1. An electric switch, comprising:

a) a base 14 of electrically non-conductive elastomeric material, b) a first electrical contact 42 mounted on the elastomeric base and arranged for connection to an electric circuit, c) a second electrical contact 44 mounted on the elastomeric base a spaced distance from the first electrical contact and arranged for connection to the electric circuit, and d) a control member 58–64 mounted to engage the elastomeric base and move said base and an adjacent one (44) of said first and second electrical contacts into electrical engagement with the other (42) of said first and second electrical contacts.

2. The electric switch of claim 1 including openings in the elastomeric base configured to receive and resiliently secure the electrical contacts removably in said base.

3. An electric switch, comprising:

a) a base 14 of electrically non-conductive elastomeric material, b) a first pair of electrical contacts 42 mounted on the elastomeric base and arranged for connection across an electric load 10 or 12, c) a second pair of electrical contacts 44 mounted on the elastomeric base a spaced distance from the first pair of electrical contacts and arranged for connection across a source 44(+/−) of electric potential, and d) a control member 58–64 mounted on the elastomeric base for resilient movement to move one of said first and second pairs of electrical contacts (44) into electrical engagement with the other of said first and second pairs of electrical contacts (42) to effect actuation of an electric load 10 or 12.

4. The electric switch of claim 3 including a plurality of groups of electrical contacts 42, 44; 46, 48; 50, 52; 54, 56, each group including a first pair of electrical contacts 42, 46, 50; 54 and a second pair of electrical contacts 44, 48, 52, 56, the control member 58, 64 being movable to engage one of the pairs of electrical contacts (44, 48, 52, 56) of each group, one at a time, and move said one pair of electrical contacts into electrical engagement with the associated pair of electrical contacts (42, 46, 50, 54), to activate an electric load 10 or 12 connected to said group of electrical contacts.

5. An electric switch for controlling a plurality of electric loads, comprising:

a) a base 14 of electrically non-conductive elastomeric material, b) a plurality of groups of electrical contacts 42, 44; 46, 48; 50, 52; 54, 56 mounted on the elastomeric base at spaced apart positions, each group including a first pair of contacts (44, 48, 52, 56) adapted for connection across a source of electrical potential and a second pair of contacts (42, 46, 50, 54) adapted for connection across an electric load 10 or 12 to be controlled, c) control means (58–64) mounted on the elastomeric base for moving one of the pairs of contacts of a group resiliently into and out of engagement with the other pair of contacts of said group, d) a plurality of third pairs of electrical contacts 34, 84 mounted on the elastomeric base at spaced apart positions, each of the third pairs of contacts being arranged to releasably connect a different electric load 10 or 12 across the second pair of contacts 42, 46, 50, 54 of each group, and e) control means 70–82 for moving one contact 34 of each third pair into and out of engagement with the other contact 84 of the pair.

6. The electric switch of claim 5 wherein the plurality of third pairs of electrical contacts comprise a plurality of first electrical contacts 34 spaced apart in a circular pattern, and a second electrical contact in the form of an annular ring 84 disposed adjacent the first electrical contacts for engagement by said first electrical contacts, one at a time, by resilient movement of the said first electrical contacts.

7. The electric switch of claim 5 wherein the plurality of electric loads 10 or 12 are devices each movable in horizontal directions by a first electric motor 12 and in vertical directions by a second electric motor 10, a first group of first and second electrical contacts 50, 52 being arranged to control movement of the devices in one horizontal direction, a second group of first and second electrical contacts 54, 56 being arranged to control movement of the device in the opposite horizontal direction, a third group of first and second electrical contacts 42, 44 being arranged to control movement of the devices in one vertical direction, and a fourth group of first and second electrical contacts 46, 48 being arranged to control movement of the devices in the opposite vertical direction, and each of the plurality of third pairs of electrical contacts 34, 84 being arranged to connect a different one of the devices 10 or 12 to the plurality of groups of first and second pairs of contacts 42, 44; 46, 48; 50, 52; 54, 56.

8. The electric switch of claim 7 wherein the plurality of electric loads 10, 12 are truck-mounted mirrors M each adjustable horizontally by a first electric motor 12 and adjustable vertically by a second electric motor 10, the groups of first and second pairs of electrical contacts 42, 44; 46, 48; 50, 52; 54, 56 are arranged on the elastomeric base 14 for actuation by control means in the form of a joystick 58–64 movable horizontally and vertically, and the third pairs of electrical contacts 34, 84 are arranged on the base 14 for actuation by control means 70–82 in the form of a rotary cam 70, 82.

9. The electric switch of claim 7 wherein the first and second groups of electrical contacts 50, 52 and 54, 56 are connected to a source of electric potential in opposite polarities to effect movement of the devices in opposite horizontal directions, and the third and fourth groups of electrical contacts 42, 44 and 46, 48 are connected to a source of electric potential in opposite polarities to effect movement of the devices in opposite vertical directions.

* * * * *

UNITED STATES PATENT AND TRADEMARK OFFICE

CERTIFICATE OF CORRECTION

PATENT NO. : 6,046,415

DATED : April 4, 2000

INVENTOR(S) : Tony M. Briski

It is certified that error appears in the above-identified patent and that said Letters Patent is hereby corrected as shown below:

On the title page: Item [73]

change"[73] Assignee: Land-Mekra North America, LLC."

to: --[73] Assignee: Lang-Mekra North America, LLC.--.

Signed and Sealed this

Thirtieth Day of January, 2001

*Attest:*

Q. TODD DICKINSON

*Attesting Officer*

*Director of Patents and Trademarks*